US007331706B2

(12) United States Patent
Gabathuler et al.

(10) Patent No.: US 7,331,706 B2
(45) Date of Patent: Feb. 19, 2008

(54) ZERO-RESETTING DEVICE FOR TWO TIME COUNTERS

(75) Inventors: Jacques Gabathuler, Collonges sous Saleve (FR); Cedric Jacot, La Chaux-de-Fonds (CH)

(73) Assignee: Breitling AG, Grenchen (CH)

( * ) Notice: Subject to any disclaimer, the term of this patent is extended or adjusted under 35 U.S.C. 154(b) by 14 days.

(21) Appl. No.: 11/484,810

(22) Filed: Jul. 12, 2006

(65) Prior Publication Data

US 2007/0019509 A1 Jan. 25, 2007

(30) Foreign Application Priority Data

Jul. 20, 2005 (EP) ..... 05405447

(51) Int. Cl.
*G04F 7/00* (2006.01)

(52) U.S. Cl. ..... 368/106

(58) Field of Classification Search ..... 368/89, 368/101–106, 107, 110, 112, 190–199
See application file for complete search history.

(56) References Cited

U.S. PATENT DOCUMENTS

| | | | | |
|---|---|---|---|---|
| 3,796,041 A | | 3/1974 | Boult | |
| 3,901,020 A | | 8/1975 | Capt | |
| 3,903,686 A | * | 9/1975 | Burki | 368/106 |
| 4,922,474 A | * | 5/1990 | Groothuis | 368/113 |
| 5,339,293 A | * | 8/1994 | Kamiyama et al. | 368/21 |
| 5,793,708 A | | 8/1998 | Schmidt et al. | |
| 6,761,478 B2 | * | 7/2004 | Schmiedchen et al. | 368/101 |

FOREIGN PATENT DOCUMENTS

| | | |
|---|---|---|
| CH | 571741 B | 1/1976 |
| EP | 1031896 A | 8/2000 |
| EP | 1462884 A | 9/2004 |
| EP | 1494097 A | 1/2005 |

OTHER PUBLICATIONS

European Search Report dated Feb. 20, 2006, in Appl. EP 05405447.

* cited by examiner

*Primary Examiner*—Vit W Miska
(74) *Attorney, Agent, or Firm*—Westerman, Hattori, Daniels & Adrian, LLP.

(57) ABSTRACT

This device for the simultaneous zero-resetting of two counters, the pivot axes of which are fixedly connected to respective heart-shaped zero-resetting cams (7, 8), comprises a zero-resetting lever (2) containing two hammers (6*c*, 6*d*), means (5) for exerting upon this lever (2) a torque for pressing the two hammers (6*c*, 6*d*) against the zero-resetting cams (7, 8), and articulation means (2*d*, 2*e*, 6*a*, 6*b*) for articulating these hammers relative to the lever (2). These articulation means comprise two pins (2*d*, 2*e*), one of which (2*d*) is engaged in a guide slot with limited amplitude (6*a*), orientated in order that the direction of the perpendicular, dropped from the axis of the pin (2*d*) onto this guide slot (6*a*), intersects the straight line joining the axes (7*a*, 8*a*) of the zero-resetting cams (7, 8) at a point capable of improving the distribution of the torque transmitted to these cams (7, 8).

1 Claim, 4 Drawing Sheets

ZERO-RESETTING DEVICE FOR TWO TIME COUNTERS

The present invention relates to a device for the simultaneous zero-resetting of two time counters, especially of a chronograph, the pivot axes of which are fixedly connected to respective heart-shaped zero-resetting cams, comprising a zero-resetting lever containing two hammers, means for exerting selectively upon this lever a torque for pressing the two hammers against the zero-resetting cams, and articulation means for articulating these hammers relative to the zero-resetting lever.

In order to carry out the zero-resetting of a counter, especially of a chronograph, a heart-shaped zero-resetting cam is attached to the axis of the counter, and a hammer, the orientation of whose striking face, resting on the symmetrical shoulders of the heart, serves to define the angular position corresponding to the zero of the counter. As soon as this cam is moved from its angular position corresponding to the zero of the counter, and as soon as the hammer strikes laterally against it, the force of the hammer is converted into a torque which rotates the cam to the point where the striking face of the hammer rests on the two shoulders of the heart-shaped cam and immobilizes it. If this cam has turned by less than 180°, the hammer rotates it by half a turn in the direction opposite to its rotational direction; if it has turned by more than 180°, the hammer brings it back to zero by rotating it in its rotational direction, in the case of a symmetrical heart.

In order to carry out the simultaneous zero-resetting of two counters, a double-hammered lever is used. Considering the different tolerances, such a device does not in practice allow the two striking faces of the hammers to rest simultaneously on the two shoulders of the two hearts in the zero-resetting position. In fact, a support will only be obtained on three of the four shoulders, so that the zero position of one of the two hammers is not precisely defined.

Various solutions exist for solving this problem. The striking face of the hammer which rests upon the two shoulders can be reworked until the striking face of the other one rests on the two shoulders. This involves a very tricky adjustment job.

It has also been proposed that one of the two hammers shall be adjustable or elastic in order to absorb the tolerances. Adjustment of a moving part spells means for securing its position. Considering the dimensions of the parts, where a wristwatch chronograph is concerned, there are strong chances of the effected adjustment being undone when it is wished to fix the adjusted position. If this concerns a frictionally linked moving part, the adjustment is at risk of being undone.

In CH 571'741, it is proposed to link the two hammers to the carrier lever by a pivot axis. In this case, the pivot axis of the hammers must be situated as close as possible to the middle of the straight line linking the pivot axes of the zero-resetting cams. Moreover, the rotational axis of the lever must be situated, relative to the straight line linking the axes of the zero-resetting cams, in a position which allows a force to be applied to the pivot axis of the hammers, the direction of which force forms, with the straight line linking the axes of the zero-resetting cams, an angle as close as possible to a right angle, such that the torque transmitted to each cam is sufficient to rotate them.

Now, a chronograph mechanism comprises a large number of parts and, because of space requirement issues, it is not always possible to dispose this pivot axis of the hammers on the carrier lever, as well as the rotational axis of the lever in the abovementioned positions.

In EP 1 462 884, there has further been proposed a mechanism comprising a sliding mobile provided with three zero-resetting hammers driven by the forked end of a zero-resetting lever engaging with a drive pin fixedly connected to the sliding mobile. In this mechanism, the axes of the three zero-resetting cams are disposed at an angle of 90°, the axis of one of the cams being at the vertex of this angle. Since the slide angle of the mobile of the hammers is preferably situated on the bisecting line of this angle, the distribution of the force exerted upon the three hammers during the zero-resetting is a function of the angle between the direction of the force exerted by the zero-resetting lever upon the drive pin of the sliding mobile and directed toward the axis of the cam situated at the vertex of the angle and on one side of this angle. It appears therefore that in this document it is the arrangement and the relative orientation of the zero-resetting cams which allows the distribution of the force transmitted by the zero-resetting lever, inasmuch as this force passes through the centre of the mobile situated at the vertex of the angle. Such an arrangement is extremely constricting and difficult to obtain, considering the space requirement problems of mechanisms as complex as those of chronographs.

The object of the present invention is to eliminate, at least partially, the drawbacks of the abovementioned solutions.

To this end, the subject of this invention is a device for the simultaneous zero-resetting of two time counters, as claimed in claim 1.

The appended drawings illustrate, diagrammatically and by way of example, an embodiment of the device forming the subject of the present invention.

The chronograph mechanism which is illustrated in part is that of a traditional mechanism using a so-called central control system with column wheel 1. It is nevertheless specified that the invention relates essentially to a new design of the hammer-type zero-resetting lever 2 and that such a lever could perfectly well be used with the same advantages in any mechanism in which two time counters (minutes and seconds, for example) must be simultaneously reset to zero using a same zero-resetting lever.

Figure 1:
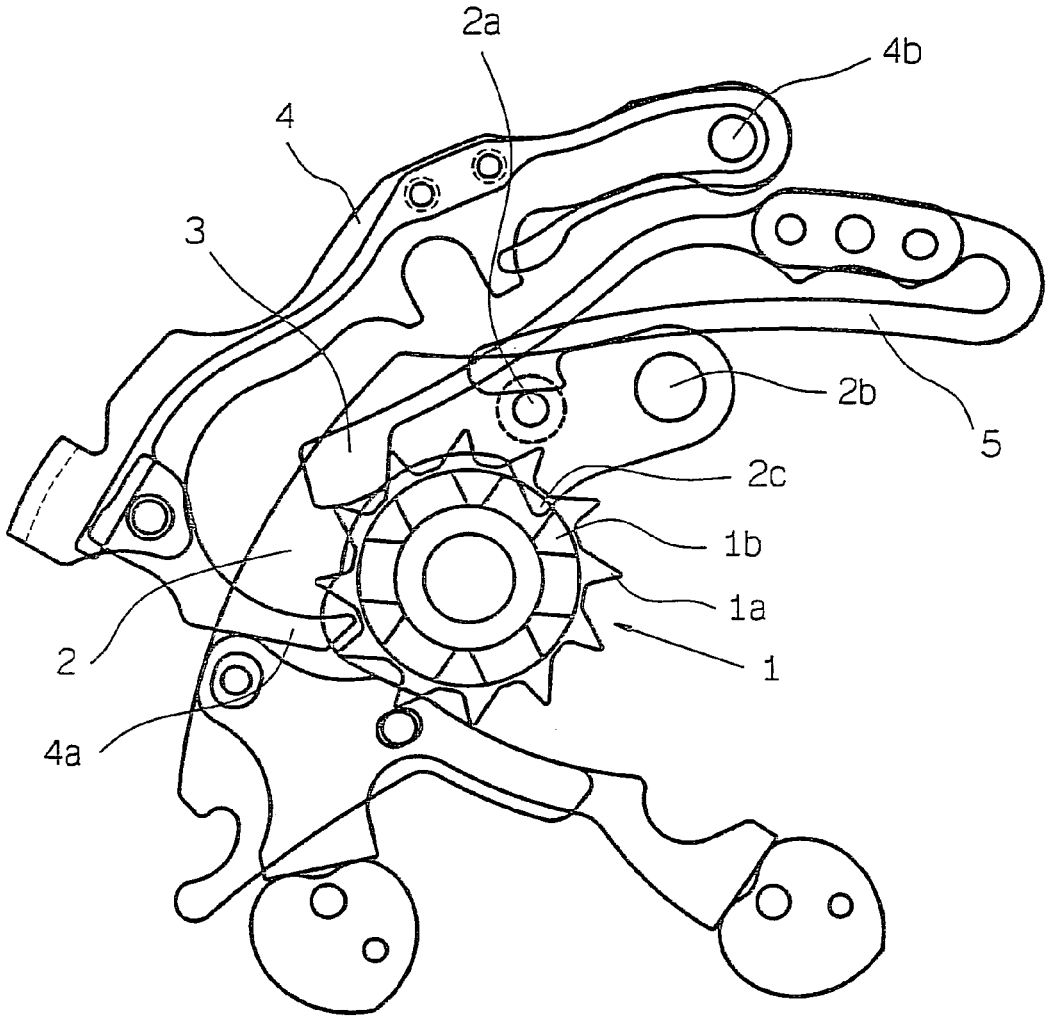
FIG. 1 is a plan view of the whole of the zero-resetting mechanism of chronograph counters in the zero-resetting position.
Figure 2:
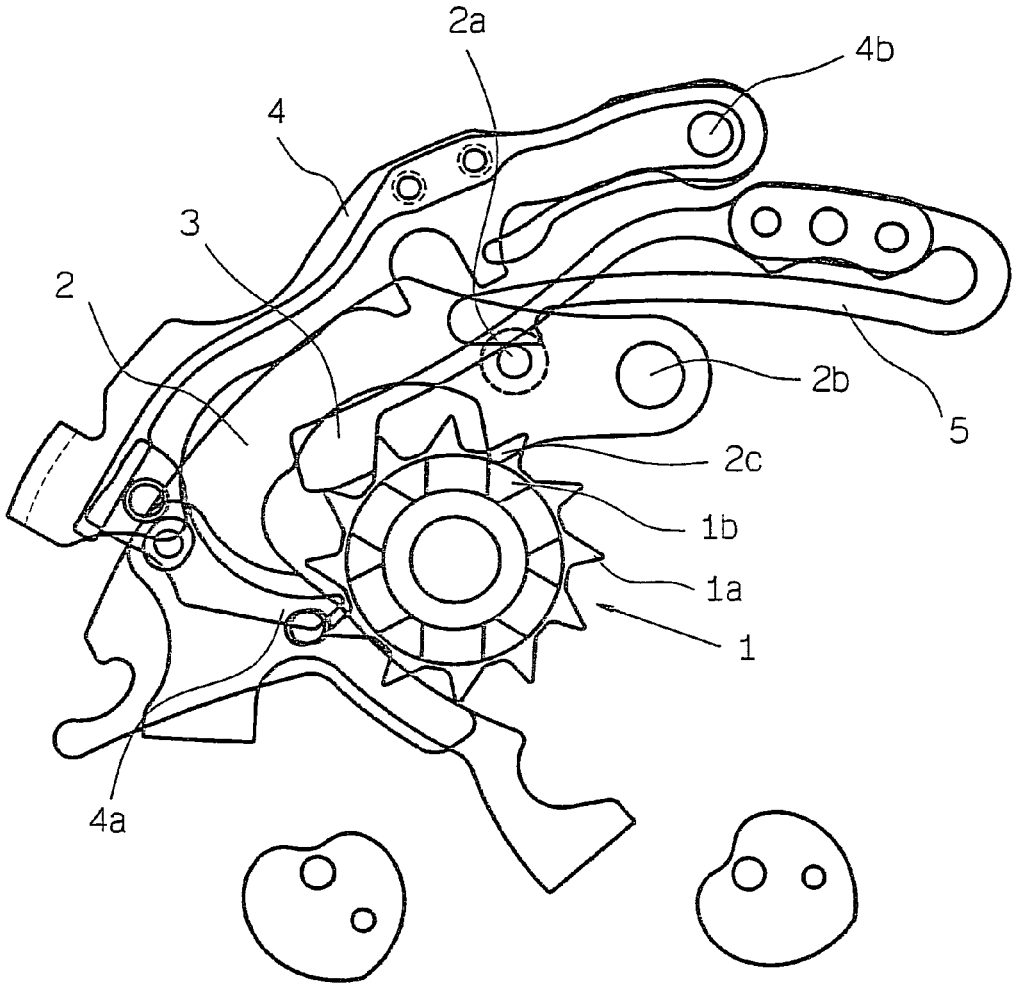
FIG. 2 is a view similar to that of FIG. 1, in the deactivated position of the zero-resetting mechanism.

The column wheel 1 is fixedly connected to a ratchet wheel toothing 1*a* engaging with a positioning click 3 and with a driving click 4*a* articulately connected to the end of an operating lever hook 4, itself articulated about an axis 4*b*. This lever hook serves to advance the column wheel 1 step by step, particularly displacing the members of the zero-resetting mechanism from the position illustrated by FIG. 1 to that illustrated by FIG. 2, and vice versa.

The part of this mechanism on which the present invention bears relates to the double-hammered zero-resetting lever 2. The latter is separately illustrated by FIG. 3, with a spring 5 which applies a force F to a pin 2*a* fixedly connected to the zero-resetting lever 2, generating a torque about the pivot axis 2*b* of this zero-resetting lever 2. This zero-resetting lever 2 is configured to provide a finger 2*c* engaging with the columns 1*b* of the column wheel 1 under the pressure of the spring 5. As can be seen from FIGS. 1 and 2, with one step in two of the toothing 1*a* of the column wheel 1, the finger 2*c* is between two columns 1*b*, and with one step in two, it rests on a column 1*b*, thereby respectively controlling the zero-resetting position illustrated by FIGS. 1 and 3 and the running position of the counters, as will be explained below.

The double-hammered zero-resetting lever 2 further comprises two pins 2*d*, 2*e*, which are respectively engaged in two openings 6*a*, 6*b* in a part 6 with two hammers 6*c*, 6*d*, namely an elongated opening 6*a* and an opening 6*b* which is dimensioned to allow the elongated opening 6*a*, hence the part 6, to turn with a limited angle about the pin 2*d*. The hammers 6*c*, 6*d* are engaged with two heart-shaped cams 7 and 8 respectively, which are each fixedly connected to the pivot axis 7*a* and 8*a* respectively of the mobile display member (not represented) of one of the two counters, for example, minute and second counters.

Figure 4:
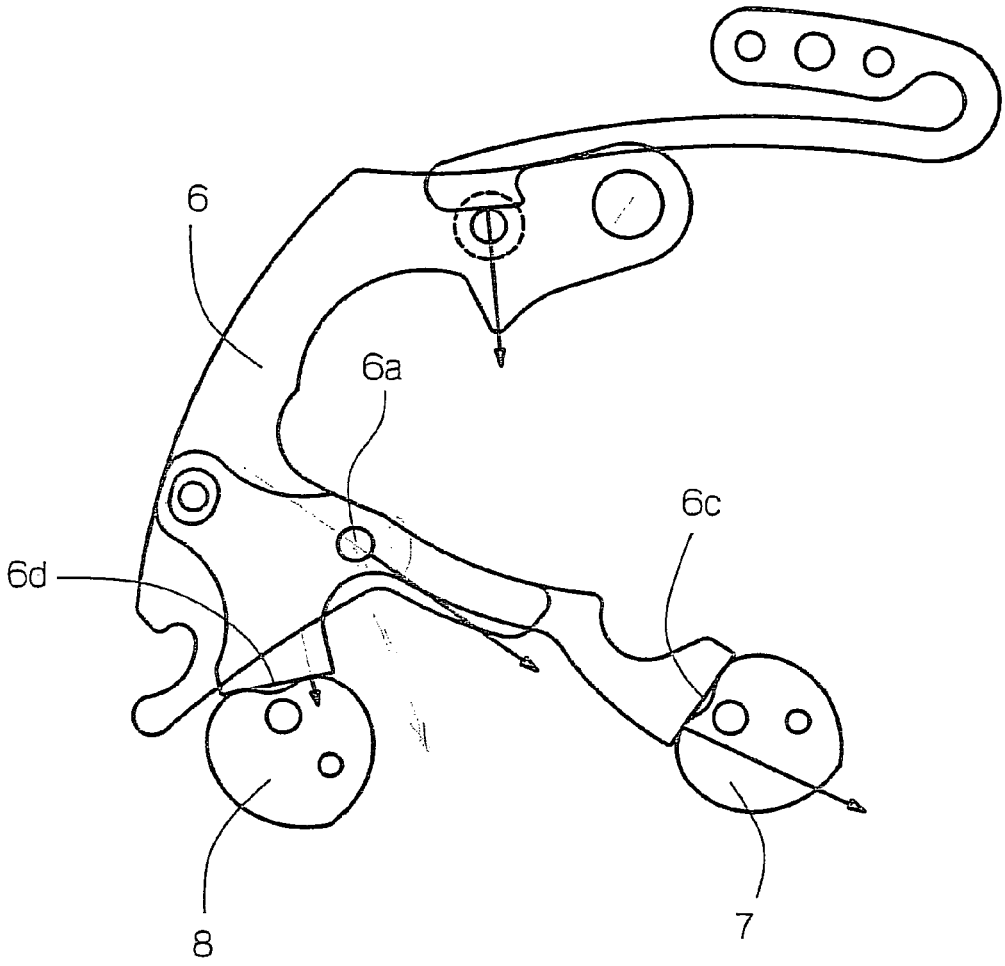
FIG. 4 is a view similar to FIG. 3, illustrating the forces applied to the cams, transposing the solution according to the prior art to the example according to the present invention.

Given a simple pivoting of the part 6 with double hammers 6*c*, 6*d* about the pin 6*a*, as in the prior art, such as is illustrated in FIG. 4, the forces transmitted to the cams 7 and 8 would be those illustrated by this FIG. 4, that is to say a very weak force upon the cam 8, the pivoting about the pin guaranteeing the contact of the two hammers 6*c*, 6*d* against the two shoulders of the two hearts 7 and 8.

Figure 3:
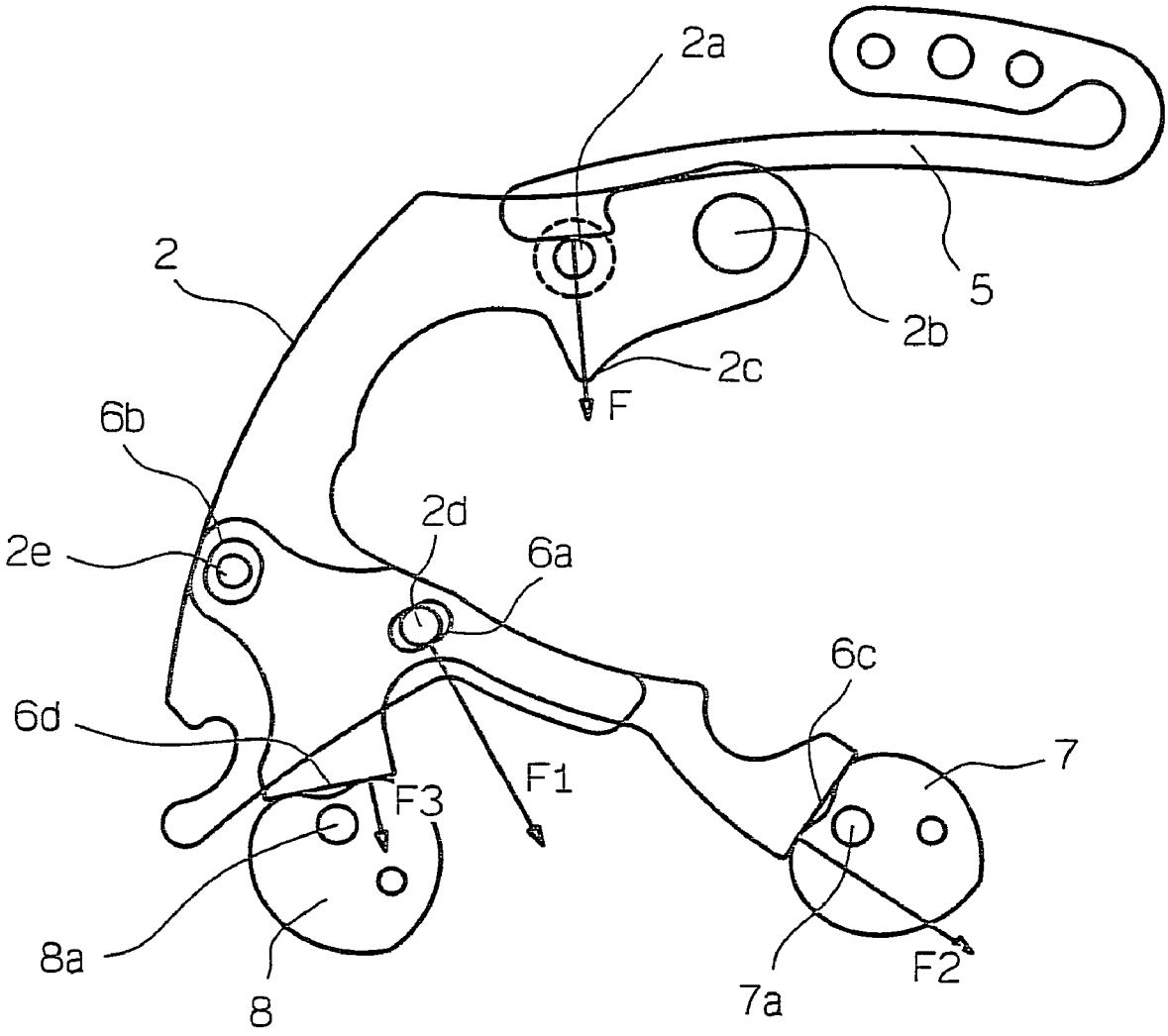
FIG. 3 is a partial view of FIG. 1, showing only the lever and the two zero-resetting hammers with the forces applied to the cams.

FIG. 3 shows the effect obtained by virtue of the existence of the elongated opening 6*a* forming a limited guide slot, according to the solution proposed by the present invention. It can be seen that this guide slot is orientated such that, during the zero-resetting, the direction of the perpendicular dropped from the axis of the pin 2*d* onto this guide slot 6*a* and which corresponds to the direction of the force F1 transmitted from the zero-resetting lever 2 to the double-hammered part 6, intersects the straight line joining the axes of the zero-resetting cams 7*a*, 8*a* at a point capable of improving the distribution of the forces F2, F3 exerted upon the cams 7 and 8 respectively. Relative to FIG. 4, it can be seen that the guide slot 6*a* allows this force F1 to be brought more in the direction of the cam 8. As is apparent, this has the effect of virtually doubling the force F3 transmitted to this cam 8 in relation to that which is transmitted in the case of FIG. 4, without reducing the force F2 exerted upon the cam 7, and this irrespective of the position of the pivot axis of the lever 2*b* and of the pin 2*d*.

As for the opening 6*b*, it is chosen to offer a degree of freedom sufficient to allow the part 6 to pivot by a limited degree about the pin 2*d* with a view to ensuring a contact between the hammers 6*c* and 6*d* and the hearts 7 and 8 respectively, which contact allows the rotation of these two hearts. In fact, if the hammers were not limited in their displacement about the pin 2*d*, they could adopt a position such that, at the moment of contact between the hammers 6*c* and 6*d* and the hearts, it is not the working surface of the hammers which acts upon the hearts, thereby causing the rotation of the hearts to be stopped.

Nevertheless, as shown by the example of FIG. 4, the simultaneous contact of the hammers 6*c*, 6*d* and of the shoulders of the hearts is no guarantee of a good force transmission for bringing the cams 7 and 8 to zero. The two problems are mutually independent. The advantage of the proposed solution lies in the fact that it allows both the orientation of the force F1 to be modified and hence the distribution of the forces F2, F3 to be improved, while guaranteeing a simultaneous contact of the hammers 6*c*, 6*d* on the shoulders of the hearts, which would not allow the achievement of the abovementioned solution of the prior art, involving a simple pivoting about an axis, since it necessitated disposing the pivot axis itself substantially midway between the pivot axes of the two hearts. Moreover, the rotational axis of the lever was bound to be situated, relative to the straight line linking the axes of the zero-resetting cams, in a position allowing a force to be applied to the pivot axes of the hammers, the direction of which force forms, with the straight line linking the axes of the zero-resetting cams, an angle as close as possible to a right angle, such that the torque transmitted to each cam is sufficient to rotate them.

The invention claimed is:

1. A device for the simultaneous zero-resetting of two time counters, especially of a chronograph, the pivot axes of which are fixedly connected to respective heart-shaped zero-resetting cams (7, 8), comprising a zero-resetting lever (2) containing two hammers (6*c*, 6*d*), means (5) for exerting selectively upon this lever (2) a torque for pressing the two hammers (6*c*, 6*d*) against the respective zero-resetting cams (7, 8), and articulation means (2*d*, 2*e*, 6*a*, 6*b*) for articulating these hammers relative to the zero-resetting lever (2); in which the force generated by said torque is essentially directed toward a first (7) of the zero-resetting cams, wherein the articulation means comprise two pins (2*d*, 2*e*), a first of which (2*d*) is engaged in a guide slot with limited displacement amplitude (6*a*), orientated so that, in the zero-resetting position, the force (F1) dropped perpendicularly from the axis of the first pin (2*d*) onto this guide slot (6*a*) intersects the straight line joining the axes (7*a*, 8*a*) of the zero-resetting cams (7, 8) at a point closer to the second of said cams (8) than is the point of intersection on this same straight line of the direction of the force exerted upon this first pin (2*d*) by said torque, and the second pin (2*e*) of which is engaged with play in an opening (6*b*) to allow a limited rotation of said hammers (6*c*, 6*d*) about the axis of the first pin (2*d*) so as to ensure a simultaneous contact of the hammers (6*c*, 6*d*) with the two shoulders of said respective zero-resetting cams (7, 8).

* * * * *